US007802325B2

(12) United States Patent
Reinhart et al.

(10) Patent No.: US 7,802,325 B2
(45) Date of Patent: Sep. 28, 2010

(54) HARTFORD LOOP MANIFOLD ASSEMBLY FOR BATHING VESSELS

(75) Inventors: James Reinhart, Milford, NJ (US); Kipley Roydon Marks, St. Heliers (NZ)

(73) Assignee: AS IP Holdco, LLC, Piscataway, NJ (US)

( * ) Notice: Subject to any disclaimer, the term of this patent is extended or adjusted under 35 U.S.C. 154(b) by 722 days.

(21) Appl. No.: 11/825,987

(22) Filed: Jul. 10, 2007

(65) Prior Publication Data

US 2008/0010738 A1 Jan. 17, 2008

Related U.S. Application Data

(60) Provisional application No. 60/831,276, filed on Jul. 17, 2006.

(51) Int. Cl.
*A61H 33/04* (2006.01)

(52) U.S. Cl. ..... 4/541.6; 4/541.4; 4/541.5

(58) Field of Classification Search ..... 4/541.1–541.6; 137/561 A

See application file for complete search history.

(56) References Cited

U.S. PATENT DOCUMENTS 4,166,296 A * 9/1979 Darrah et al. ..... 4/488
4,218,784 A * 8/1980 Richards ..... 4/541.5
4,512,042 A * 4/1985 Striegel et al. ..... 4/496
4,553,566 A * 11/1985 Barclay et al. ..... 137/625.11
4,672,692 A * 6/1987 Savage ..... 4/541.2
4,922,958 A * 5/1990 Lemp ..... 137/561 A
5,233,963 A * 8/1993 Gregorius et al. ..... 123/456
5,267,359 A * 12/1993 Clark ..... 4/509
5,444,879 A * 8/1995 Holtsnider ..... 4/541.1
5,457,825 A * 10/1995 Holtsnider ..... 4/541.1
6,185,757 B1 * 2/2001 Gardenier et al. ..... 4/541.1
7,503,082 B2 * 3/2009 Castellote ..... 4/541.5

* cited by examiner

*Primary Examiner*—Khoa D Huynh
(74) *Attorney, Agent, or Firm*—Matthew K. Ryan; Paul A. Levy; Frommer Lawrence & Haug LLP

(57) ABSTRACT

Hartford loop manifold assembly installed in operable communication with an air control assembly in a whirlpool bathing system. The manifold assembly includes a tubular manifold housing having a coupling member in intussusceptible relation therewith. The manifold housing has an elongate body and an elongate wall coextensive with an upper body proximate extent and a lower body distal extent thereof. The elongate wall includes an internal manifold wall delineating a reception lumen that accommodates insertion of the coupling member therein. The internal manifold wall is disposed by a predetermined distance from an external manifold wall in parallel therewith to define a flow area therebetween. The external manifold wall has at least one outlet depending generally normally therefrom. Each outlet has a lumen defined therethrough for unoccluded fluid communication between each manifold flow area and at least one conduit detachably coupled to each outlet extent.

9 Claims, 3 Drawing Sheets

HARTFORD LOOP MANIFOLD ASSEMBLY FOR BATHING VESSELS

This application claims priority from U.S. Ser. No. 60/831,276, filed Jul. 17, 2006, and incorporated by reference herein.

FIELD OF THE INVENTION

The present invention is directed to improved operation of whirlpool bathtubs without increasing the manufacturing, installation and maintenance costs therefor. In particular, the present invention is directed to a Hartford loop manifold assembly that is employed in whirlpool bathtub products to integrate cost-effective and compact water prevention means with a submersible air control assembly.

BACKGROUND OF THE INVENTION

A Hartford loop comprises a safety device that is widely employed in whirlpool and spa applications to prevent backflow of water into one or more electrical components (including, but not limited to, electrical pumps, electrical blowers, water heaters, ozonators and like devices that are widely employed in commercial whirlpools and spas). In such applications, creating a Hartford Loop simply means to loop a conduit as high as possible (ideally above the water line) prior to coupling the conduit with a selected component. As seen in U.S. Pat. No. 5,267,359 to Clark (hereinafter "Clark", incorporated by reference in its entirety), a typical Hartford loop creates a trap with vertical leg portions X, Y and Z (see FIGS. 2 and 4) by which a first level A designates the highest level of coupling between legs X and Y; level B designates the lowest level at which water can spill from the trap to a blower (40) in fluid communication therewith; level C designates the lowest level of coupling between legs Y and Z; and level D designates the uppermost level of the top of the spa and thus the highest water level P. The Hartford loop height (also known as the "head") is defined as the distance between levels A and D. During spa operation, water flow from spa (10) fills leg Z up to level C and thereafter spills into leg Y. Water subsequently traverses the connection between legs X and Y and approaches level A thereat. At this point, pressure from the spa water slightly compresses an air column that is trapped in leg Y and its connection to leg Z. Such compression suppresses travel of the water beyond level E, thereby creating an inexpensive yet effective means of preventing water damage to blower (see Clark, column 3, line 67 to column 4, line 43).

When employed in whirlpool bathing applications, a Hartford loop comprises an effective and inexpensive means to prevent backflow into electrical devices and thereby minimize the consequent fiscal and temporal costs associated with associated malfunction and repair. The prior art, however, lacks any teaching of the Hartford loop in a manifold configuration to ensure proper operation of a submersible air assembly in operable communication therewith. In practice, current whirlpool embodiments still employ one or more check valves at each Hartford loop that impart significant fiscal and temporal expense to the manufacture, installation and maintenance of whirlpool systems. It is therefore desirable to employ the principles inherent in Hartford loop applications to eliminate expensive check valves while retaining the benefit of water backflow prevention. It is further desired to achieve such benefit in concert with a submersible air control assembly so as to prevent backflow through such assembly and thereby ensure optimal operation thereof.

SUMMARY OF THE INVENTION

It is an advantage of the present invention to provide a means to obviate water backflow to a submersible air control assembly that is employed in a whirlpool bathing system. Such water flow prevention sustains cost-effective and reliable deep-soaking designs for bathing vessels.

It is another advantage of the present invention to eliminate costly check valves in whirlpool bath applications. Elimination of the temporal and fiscal cost associated with manufacture, installation and maintenance of such check valves is achieved without attenuation of the backflow prevention benefits thereof.

In the attainment of these and other advantages, the present invention provides a Hartford loop manifold assembly for bathing vessels such as whirlpool tubs. The disclosed manifold assembly is installed in operable communication with an air control assembly along an outer surface of a whirlpool bathing vessel and includes a tubular manifold housing having a coupling member in intussusceptible relation therewith. The manifold housing has an elongate body with an upper body portion having a proximate extent and a distal extent, a lower body portion having a proximate extent and a distal extent, and an elongate wall coextensive with the upper body proximate extent and the lower body distal extent. The elongate wall includes an internal manifold wall having a proximate extent from which a reception lumen extends to the lower body distal extent. The internal manifold wall is disposed by a predetermined distance from an external manifold wall in parallel therewith, wherein the external manifold wall is coextensive with the upper body proximate extent and the upper body distal extent so as to define a flow area between the internal and external manifold walls. The external manifold wall has at least one outlet depending generally normally therefrom to a distalmost outlet extent. Each outlet has a lumen defined therethrough for unoccluded fluid communication between each manifold flow area and at least one conduit detachably coupled to each outlet extent.

The coupling member of the present invention manifold assembly includes a generally annular body with an elongate, tubular lumen defined therethrough. The annular body has a predetermined outside diameter for releasable engagement by the internal manifold wall when the reception lumen accepts insertion of the annular body thereby to a predetermined extent measured from the proximate extent of said internal manifold wall. This predetermined extent defines a Hartford loop height.

Various other advantages and features of the present invention will become readily apparent from the following detailed description.

DETAILED DESCRIPTION OF THE PREFERRED EMBODIMENTS

Figure 2:
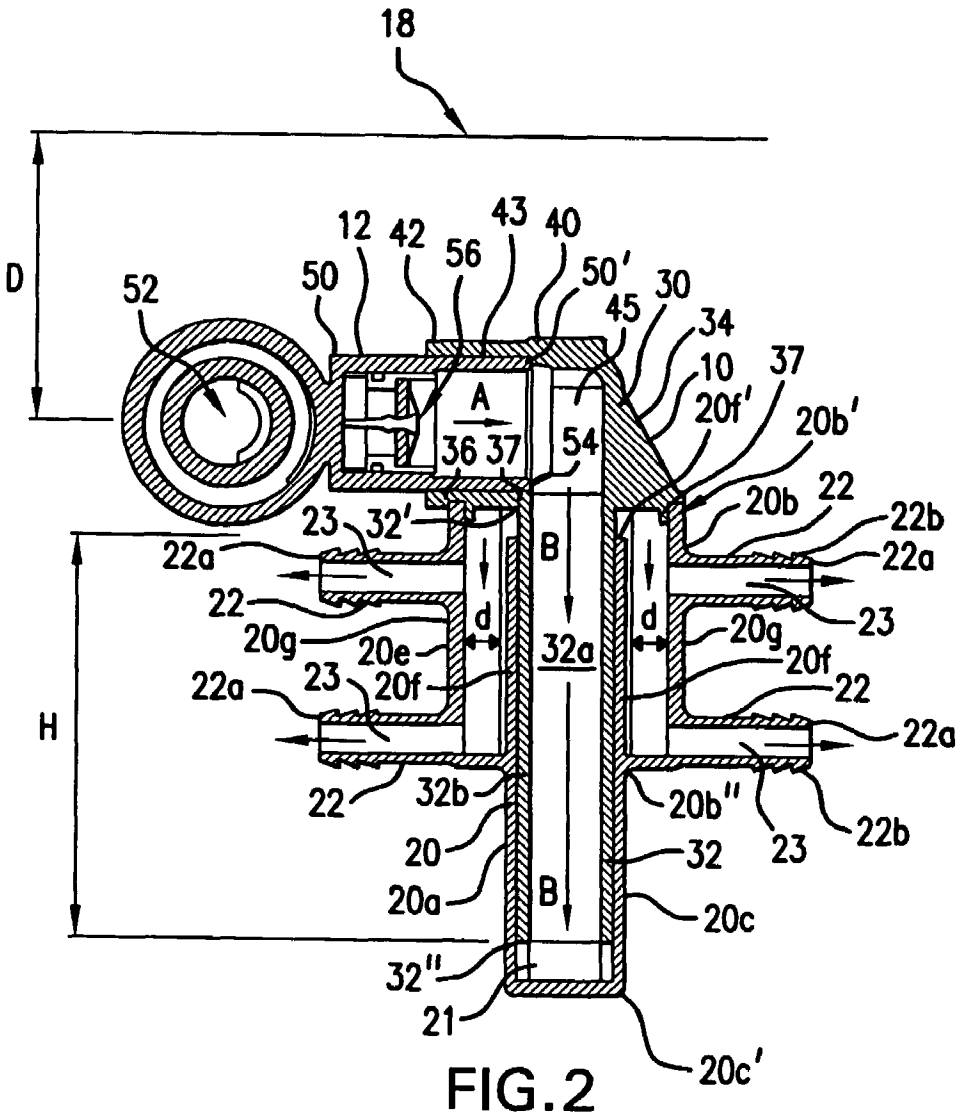
FIG. 2 shows a sectional view of the Hartford loop manifold and air control assemblies of FIG. 2.
Figure 1:
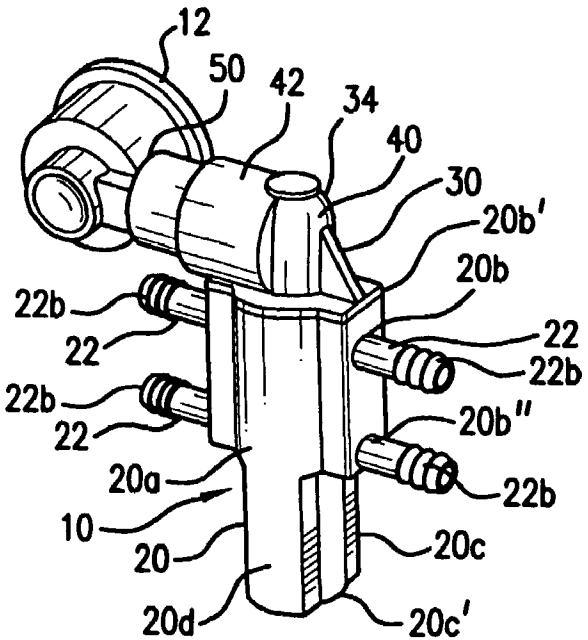
FIG. 1 is a perspective view of a Hartford loop manifold assembly of the present invention as used with a conventional air control assembly.
Figure 3:
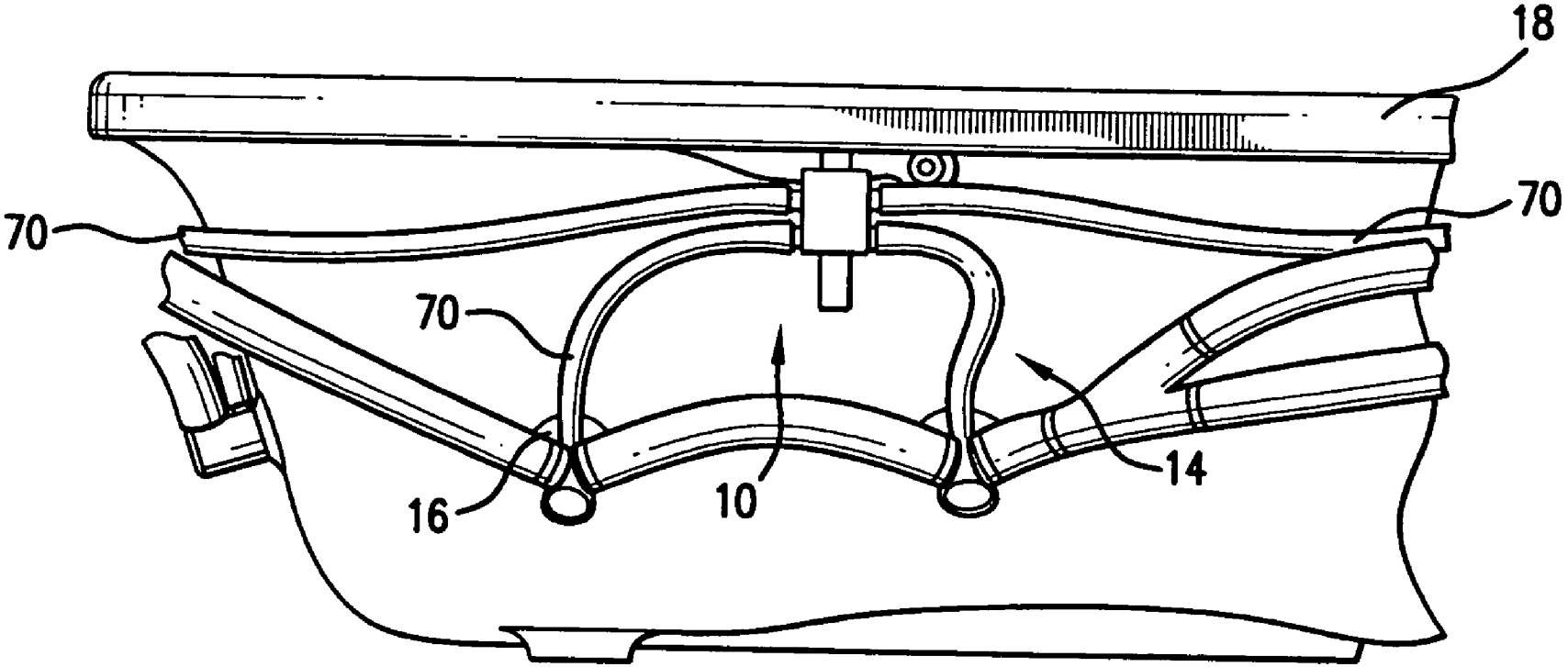
FIG. 3 shows a Hartford loop manifold assembly of the present invention installed as part of a whirlpool bathing system.

Now referring to FIGS. 1 to 3, wherein like numbers identify like elements, a Hartford loop manifold assembly 10 of the present invention is shown in FIG. 1. Manifold assembly 10 is installed in operable communication with an air control assembly 12 along an outer surface of a whirlpool bathing vessel 14 (as shown in FIG. 3). Whirlpool 14 also has an inner surface along which at least one whirlpool jet 16 is disposed for the injection of water and/or air into a full whirlpool tub. The construction and function of at least one whirlpool jet 16 may be selected from a plurality of well known and commercially available whirlpool jets and comprise no part of the present invention.

Manifold assembly 10 and air control assembly 12 are placed at a minimum distance D adjacent a whirlpool rim 18 so as to ensure optimal function thereof. Operation of whirlpool 14 is effected by a conventional whirlpool motor (not shown) as is well known in the art. Other well-known implements such as an ozonator, pump, blower and complementary devices are also well-known in the art for use with whirlpool bathing systems and are thereby omitted from this disclosure.

As particularly seen in FIGS. 1 and 2, manifold assembly 10 includes a tubular manifold housing 20 having an elongate body 20*a*. Body 20*a* includes an upper body portion 20*b* having a proximate extent 20*b*' and a distal extent 20*b*", and a lower body portion 20*c* having a distal extent 20*c*' (wherein a proximate extent of lower body portion 20*c* is delineated by upper body distal extent 20*b*"). An elongate wall 20*d* that is coextensive with upper body proximate extent 20*b*' and lower body distal extent 20*c*' includes an internal manifold wall 20*f* having a proximate extent 20*f*' from which a reception lumen 21 extends to lower body distal extent 20*c*'. Internal manifold wall 20*f* is disposed by a predetermined distance d from an external manifold wall 20*g* in parallel therewith. External manifold wall 20*g* is coextensive with upper body proximate extent 20*b*' and upper body distal extent 20*b*" so as to define a flow area between manifold walls 20*f* and 20*g*.

External manifold wall 20*g* has at least one outlet 22 depending generally normally therefrom to a distalmost outlet extent 22*a*. Each outlet 22 has a lumen 23 defined therethrough for unoccluded fluid communication between each flow area and at least one conduit 70 detachably coupled to each outlet extent 22*a* (see in FIG. 3). Each conduit 70 delivers air from air control assembly 12 to a jet 16 as is known in the art. Fastening of a conduit 70 to an outlet extent 22*a* may be effected by at least one of a plurality of known fastening means that is conducive to practice of the present invention. As shown in FIGS. 1 and 2, a plurality of threads 22*b* is defined at each outlet extent 22*a* to accommodate frictional fit or a corresponding threaded fit of a conduit 70 thereto. In the alternative, fastening may be effected by clamping, snap-tight or epoxy engagement and any combination and equivalent thereof.

Manifold assembly 10 further includes an intussusceptible coupling member 30 comprising a coupling member body 32 (shown herein to assume a generally annular configuration, although any geometry may be employed that is conducive to practice of the present invention) having an elongate lumen 32*a* defined therethrough. Coupling body 32 assumes a predetermined outside periphery for releasable engagement by internal manifold wall 20*f* when coupling body 32 is inserted in reception lumen 21 thereof. Coupling body 32 has a proximate extent 32', a distal extent 32" and an elongate wall 32*b* coextensive therewith. Upon insertion of coupling body 32 in reception lumen 21, a portion of wall 32*b* is disposed therein such that a predetermined extent measured from proximate extent 20*f*' of internal manifold wall 20*f* to coupling body distal extent 32" defines a Hartford loop height H (also called the "head"). Manifold assembly housing 20 and coupling member 32 are desirably injection molded from plastic and assembled using a seal welded joint, although other materials and manufacturing methods may be employed that are amenable to practice of the present invention.

Coupling member 32 further includes a coupling extension 34 provided at coupling body proximate extent 32' and selectively integral therewith. Coupling extension 34 includes a shoulder portion 36 that engages upper body proximate extent 20*b*' when coupling body 32 is inserted in reception lumen 21. Shoulder portion 36 selectively includes at least one detachable fastening means such as one or more detents 37 shown in FIG. 2, although it is understood that any equivalent fastening means may be substituted therefor (including, but not limited to, complementary notches and grooves, complementary recesses, epoxies and any combinations and equivalents thereof). Shoulder portion 36 supports a hub portion 40 thereon from which a connecting member 42 generally depends. Although connecting member 42 is shown as depending generally normally relative to hub portion 40, it is understood that connecting member 42 may depend upward or angularly therefrom depending upon disposition of air control assembly 12 within a whirlpool tub wall. An extension lumen 43 is defined through connecting member 42 to establish fluid communication with each of a linking lumen 45 (defined in hub portion 40) and lumen 32*a* of coupling body 32. Coupling extension 34 is disposed proximate whirlpool rim 18 when manifold assembly 10 is installed within a whirlpool bathing system (see FIG. 3).

Connecting member 42 of coupling member 32 detachably engages air control assembly 12 along an air connector member 50 thereof. Air control assembly 12 includes an air control inlet 52 from which air connector member 50 depends to a distalmost extent 50'. Connector extent 50' engages a generally annular stop 54 in connecting member 42 so as to house an umbrella valve 56 of air control assembly 12 in operable communication therebetween. Air control assembly 12 may assume equivalent configurations which are well known in the art for use in whirlpool bathing systems and therefore forms no part of the present invention.

Figure 4:
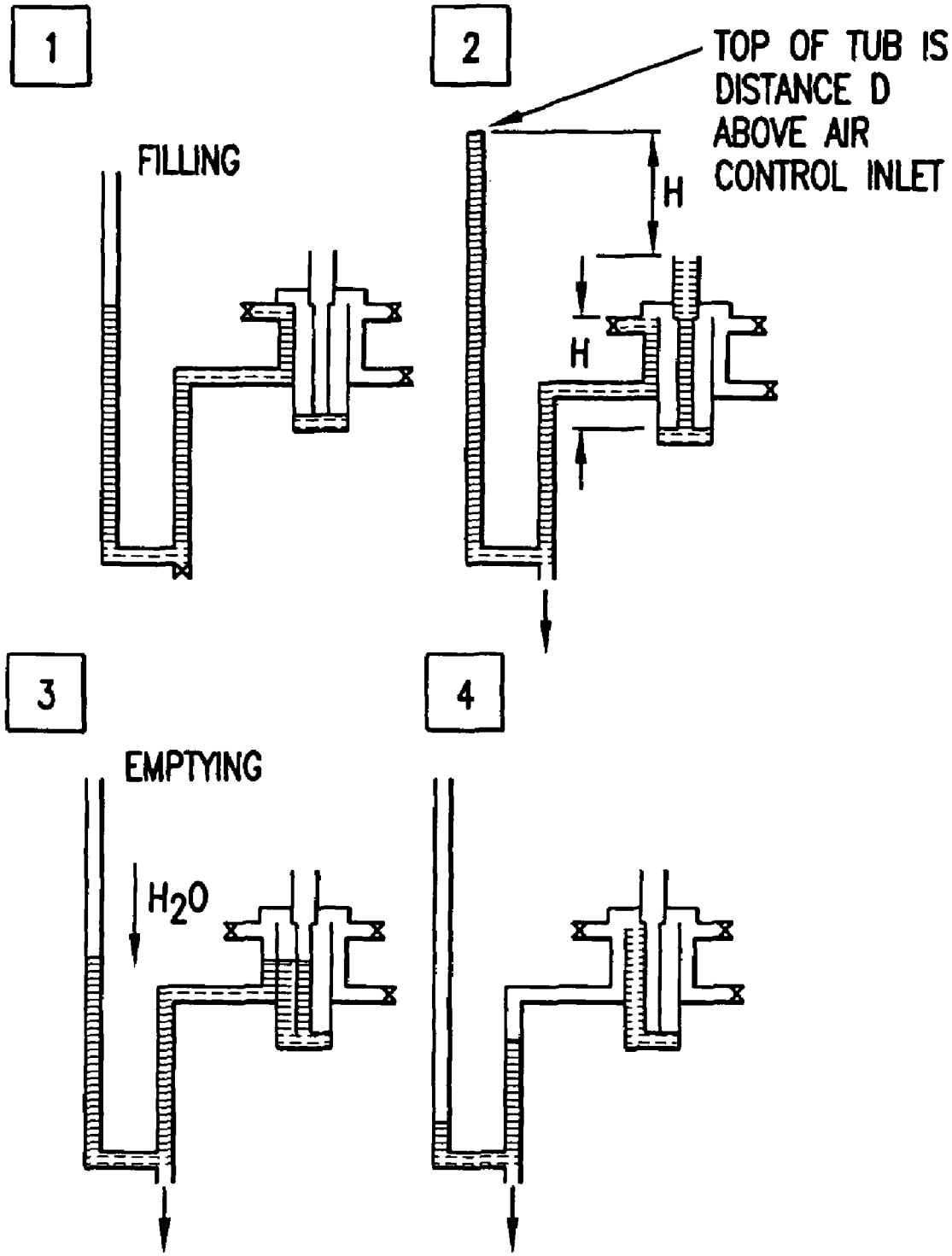
FIG. 4 shows stages of operation of the present invention Hartford loop manifold assembly during use in a whirlpool bathing system.

Now referring to FIGS. 3 and 4, manifold assembly 10 (including manifold housing 20 and coupling member 30 thereof) and air control assembly 12 are assembled in operable communication on whirlpool tub 14. Each outlet lumen 23 communicates with an adjacent manifold flow area defined by manifold walls 20*f* and 20*g* so as to direct air from manifold assembly 10 to at least one corresponding jet 16 via at least one conduit 70 coupled therebetween. Upon activation of the whirlpool motor (not shown), air enters air control inlet 52 of air control assembly 12 and passes through open umbrella valve 56 (see arrow A of FIG. 2). This air, after passing through the manifold flow areas and further traversing lumen 32*a* of coupling body 32 (the airflow path shown by arrows B in FIG. 2), exits manifold assembly 10 through outlets 22 for delivery to jets 16 via conduits 70. When operation of the whirlpool motor ceases, residual water reverses flow through conduits 70 and enters manifold assembly 10 as water fills tub 14 (see FIG. 4, stage (1)). Manifold assembly 10 creates an air pocket that prevents water from reaching air control inlet 52, even after the tub is filled to rim 18 and air control assembly 12 is submerged in water (see FIG. 4, stage (2)). Upon draining whirlpool 14, water is correspondingly drawn from manifold assembly 10 and exits therefrom, leaving less than 5 ml of residual water (see FIG. 4, stages (3) and (4)).

The manifold assembly of the present invention employs a conventional Hartford loop application in an unconventional manner to provide a multiple inlet manifold that is both functional and compact. The manifold assembly of the present invention enables the consumer to fill a whirlpool tub above the air control level without incurring a tub leak. The manifold is easy to install and is an extremely cost-effective alternative to using inline check valves. Also, because of its compact size, the manifold is less prone to damage than using a conventional Hartford loop that is made from piping, eliminating a bulky configuration that is difficult to conceal around the perimeter of the bathtub.

Various changes to the foregoing described and shown structures are now evident to those skilled in the art. The matter set forth in the foregoing description and accompanying drawings is therefore offered by way of illustration only and not as a limitation. Accordingly, the particularly disclosed scope of the invention is set forth in the following claims.

What is claimed is:

1. A Hartford loop manifold assembly for use with an air control assembly in a whirlpool bathing system, comprising:

a manifold housing, comprising an elongate body with an upper body portion having a proximate extent and a distal extent, a lower body portion having a proximate extent and a distal extent, and an elongate wall coextensive with said upper body proximate extent and said lower body distal extent, said elongate wall including an internal manifold wall having a proximate extent from which a reception lumen extends to said lower body distal extent, said internal manifold wall being disposed by a predetermined distance from an external manifold wall in parallel therewith, said external manifold wall being coextensive with said upper body proximate extent and said upper body distal extent so as to define a flow area between said internal manifold wall and said external manifold wall;

wherein said external manifold wall has a plurality of outlets depending generally normally therefrom to a distalmost outlet extent, each of said plurality of outlets having a lumen defined therethrough for unoccluded fluid communication between each said manifold flow area and at least one conduit detachably coupled to each of said plurality of outlet extents; and a coupling member in intussusceptible relation with said manifold housing, said coupling member comprising an elongate body having a proximate extent, a distal extent and an elongate wall coextensive therebetween, said elongate wall delineating a lumen defined through said coupling member body, said coupling member body having a predetermined periphery for releasable engagement by said internal manifold wall when said reception lumen accepts insertion of said coupling member body thereby, such that, upon insertion of said coupling member body in said reception lumen, a predetermined extent measured from said proximate extent of said internal manifold wall to said coupling member body distal extent defines a Hartford loop height, wherein when in operation the manifold assembly creates an air pocket that prevents water from reaching the air control assembly, even after the air control assembly is submerged in water and upon draining of the whirlpool assembly, water is drawn from the manifold assembly and exits therefrom, leaving less than a predetermined amount of residual water dependent from the Hartford loop height.

2. The Hartford loop manifold assembly according to claim 1, wherein said coupling member further includes a coupling extension provided at said proximate extent of said coupling member body.

3. The Hartford loop manifold assembly according to claim 2, wherein said coupling extension includes a shoulder portion that engages said manifold housing upon insertion of said coupling body in said reception lumen.

4. The Hartford loop manifold assembly according to claim 3, wherein said shoulder portion includes at least one detachable fastening means thereat.

5. The Hartford loop manifold assembly according to claim 3, wherein said coupling member further includes a connecting member depending generally from said shoulder portion, said connecting member having an extension lumen defined therethrough that establishes fluid communication with said lumen of said coupling member body.

6. The Hartford loop manifold assembly according to claim 5, wherein at least one said conduit delivers air from an air control assembly in operable communication with said manifold assembly to at least one whirlpool jet in communication therewith.

7. The Hartford loop manifold assembly according to claim 6, wherein each said outlet lumen is in fluid communication with at least one said manifold flow area so as to direct air from said manifold assembly to at least one said corresponding jet via said at least one conduit coupled therebetween.

8. The Hartford loop manifold assembly of claim 6, wherein said connecting member detachably engages said air control assembly.

9. The Hartford loop manifold assembly of claim 8, wherein said air control assembly includes an umbrella valve disposed in operable communication with at least one of said connecting member and said air control assembly.

* * * * *